US005137161A

United States Patent [19]

Dutton

[11] Patent Number: 5,137,161

[45] Date of Patent: Aug. 11, 1992

[54] BOOM SUPPORT ASSEMBLY

[75] Inventor: Vance D. Dutton, Marion, Ohio

[73] Assignee: Dresser Industries, Inc., Dallas, Tex.

[21] Appl. No.: 584,550

[22] Filed: Sep. 18, 1990

[51] Int. Cl.[5] ..... B66C 23/62; B66C 23/42; B66C 23/00; B66C 23/34

[52] U.S. Cl. ..... 212/229; 212/186; 212/201; 212/202; 212/167; 212/177; 212/176; 212/179

[58] Field of Search ..... 212/1, 59, 186, 167, 212/176, 177, 179, 201, 202, 229, 237, 245, 260

[56] References Cited

U.S. PATENT DOCUMENTS

| | | | |
|---|---|---|---|
| 2,191,696 | 10/1936 | Jacoby et al. | 212/59 |
| 3,757,959 | 9/1973 | Thompson et al. | 212/1 |
| 4,038,765 | 8/1977 | Sankey et al. | 37/116 |
| 4,096,957 | 6/1978 | Iverson et al. | 214/145 |
| 4,251,182 | 2/1981 | Schroeder | 414/723 |
| 4,428,255 | 1/1984 | Fischer | 74/813 |
| 4,491,436 | 1/1985 | Easton | 403/122 |

*Primary Examiner*—Joseph F. Peters, Jr.
*Assistant Examiner*—Kenneth Lee
*Attorney, Agent, or Firm*—Johnson & Gibbs

[57] ABSTRACT

A boom support assembly for an earth working machine, which includes a winch, a pair of tension members and a pendant pin link interposed between tension members. The first tension member is a boom support pendant secured to a boom point of a boom and the first end of the pendant pin link. The second tension member is a boom raising rope which is received over a plurality of gantry sheaves mounted on the top portion of a gantry structure and attached to the winch at one end and attached to the second end of the pendant pin link. The gantry sheaves are mounted on an alignment apparatus that has a sheave shaft mounted in an eccentric bore of a pair of cartridges rotatable in the top portion of the gantry structure. This alignment apparatus insures the proper positioning of a through bore of the pendant pin link between support openings in the top portion of the gantry.

10 Claims, 7 Drawing Sheets

BOOM SUPPORT ASSEMBLY

FIELD OF THE INVENTION

This invention relates to earth-working machines having multiple boom lengths, and more particularly to a boom support assembly for holding a multiple length boom in an operating position.

BACKGROUND OF THE INVENTION

Currently some earth-working machines such as dragline excavators are designed with a multiple length boom. This boom includes removable center sections that can increase or decrease its overall length to accommodate changes in mine configuration. At the mine site, the dragline excavator generally raises its boom from its starting horizontal position to an optimum angle which defines its operating position.

These dragline excavators generally include a rotating main frame having a gantry rising upwardly to support a pivotally mounted boom by means of tension members (wire rope) running from a winch on the frame to the top of the gantry out to the point of the boom and back to the gantry. Sheaves are positioned at the boom point and top of the gantry to receive the wire rope attached to the winch. The winch reeves the wire rope around the gantry sheaves and the boom point sheaves to draw the boom up to its operating position. Upon attaining the operating position, the winch is mechanically locked to hold this boom position. Still, this apparatus for supporting the boom is susceptible to the boom slipping down due to the unreliability of the winch lock. Also, this apparatus requires a long wire rope that is expensive to manufacture, and a sheave on the boom point that adds weight to the boom, reducing the maximum payload weight rating for the dragline.

Another apparatus for raising and supporting the boom in a fixed operating position is a wire rope/-sheave/pendant pin assembly arrangement. The wire rope is reeved by a winch located on the rotating frame, received around sheaves located at the top portion of the gantry structure and around sheaves attached to one end of a pin link of the pendant pin assembly. On the opposite end of the pin link is a boom support pendant that is attached to the boom point. The boom is raised until the pin link reaches the top portion of the gantry structure and is adjacent support openings in the gantry. The axis through the boom support pendant and pendant pin assembly is aligned with the centerline axis of the support openings, so that a through bore of the pin link is concentrically aligned with the support openings. A boom support pin is inserted through the support openings and the pin link through bore to hold the boom via the boom support pendant in its fixed operating position. This apparatus provides a reliable means for supporting a fixed length boom in its operating position at an optimum angle. But by varying the overall boom length at this optimum angle, the axis through the boom support pendant and pendant pin assembly is misaligned with the support openings. This results in the inability of inserting the support pin through the support openings and the through bore of the pin link. Therefore, this apparatus is inappropriate for multiple length boom earth-working machines.

SUMMARY OF THE INVENTION

It is a principal object of this invention to provide an assembly that raises and supports a boom in an operating position at an optimum angle for an earth-working machine having a multiple length boom.

It is another object of this invention to provide an apparatus that aligns the through bore of a pendant pin link assembly with support openings in the top portion of a gantry structure of an earth-working machine.

It is a feature of this invention to have a rotatable eccentric cartridge that aligns the pendant pin link assembly with the support openings.

It is an advantage of this invention that a multiple length boom for an earth-working machine is raised and securely maintained in its operating position. The boom is secured in place by a boom support assembly that is easy to set up and use, and of relatively simple and economical design, manufacture and assembly.

In accordance with the present invention, an earth working machine includes a rotatable frame, a gantry mounted on the frame, a boom pivotally mounted on the frame and an assembly for raising and supporting the boom in an operating position. The boom raising and support assembly includes a winch mounted on the frame, a pendant pin link assembly having a pin link with a first end and a second end with a through bore, and gantry sheaves adjacent aligned support openings through the top portion of the gantry. The assembly has a pair of tension members, the first is a boom support pendant secured to the first end of the pin link and the boom point of the boom. The second tension member is a boom raising rope received over the gantry sheaves, having one end attached to the winch and the other end received on the second end of the pin link. The gantry sheaves are rotatably mounted on an alignment apparatus having a sheave shaft that is mounted in an eccentric bore of a cartridge rotatable in a bore of the gantry.

In accordance with an important aspect of the invention, the reeving of the boom raising rope by the winch draws the pendant pin link assembly towards the gantry sheaves and raises the boom up to an optimum angle defining the operating position. The operating position is maintained when the pendant pin link assembly is adjacent the gantry sheaves and has the pin link through bore concentrically aligned with the support openings in the top portion of the gantry for receiving a support pin. For a different length boom at the optimum angle, the eccentric cartridges are rotated to a predetermined position for a specific boom length and locked in place so that the through bore in the pin link is again properly positioned between the support openings in the gantry.

Other objects, features and advantages of the invention will be apparent in the following description and claims in which the invention is described, together with details to enable persons skilled in the art to practice the invention, all in connection with the best mode presently contemplated for the invention.

BRIEF DESCRIPTION OF THE DRAWINGS

Drawings accompanying the disclosure and the various views thereof may be briefly described as.

BEST AVAILABLE COPY

Figures 4, 5A, 5B, 6:
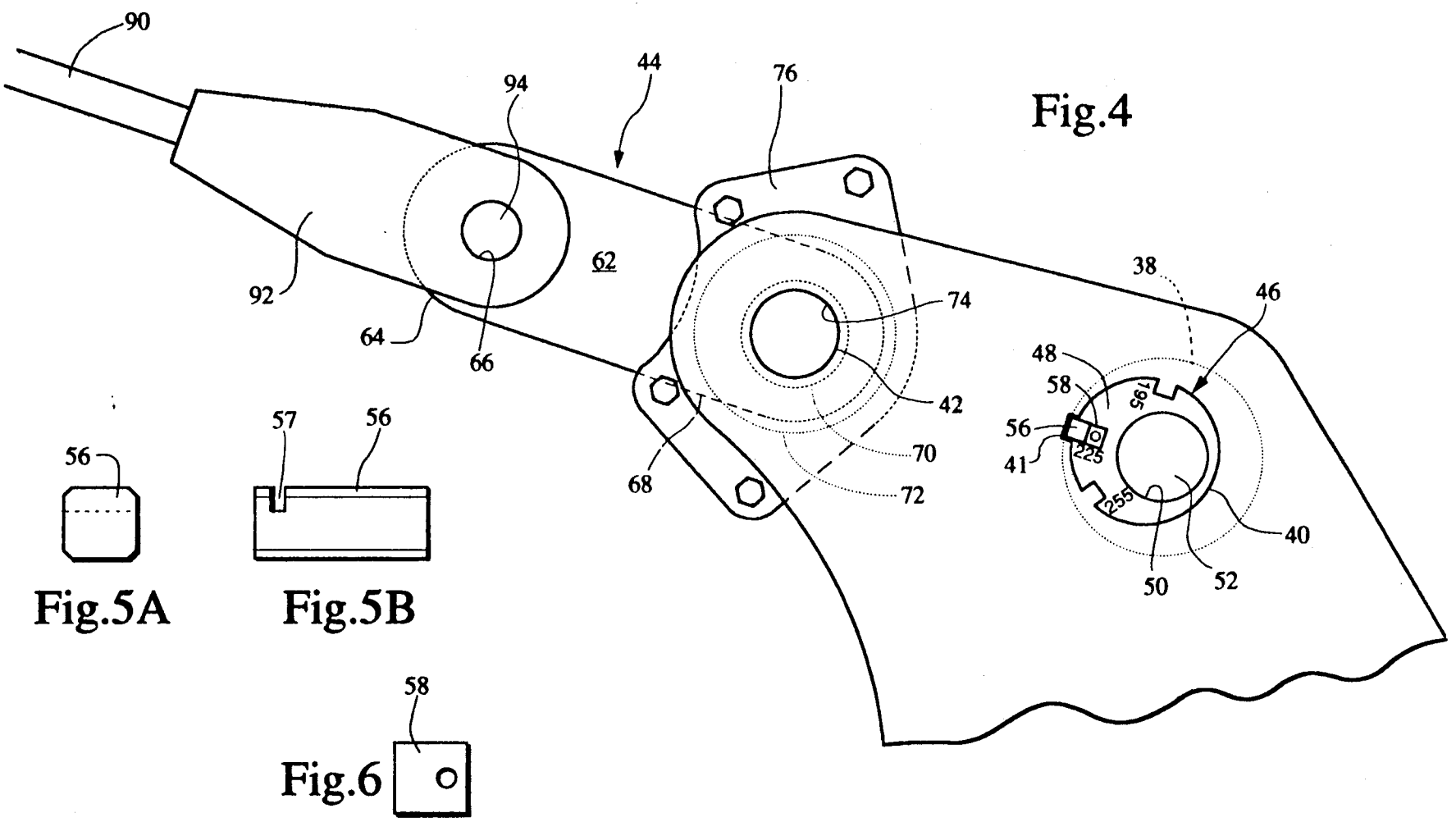
FIG. 4 is an enlarged side elevational view illustrating in detail an alignment apparatus of this invention.
Figures 7, 8:
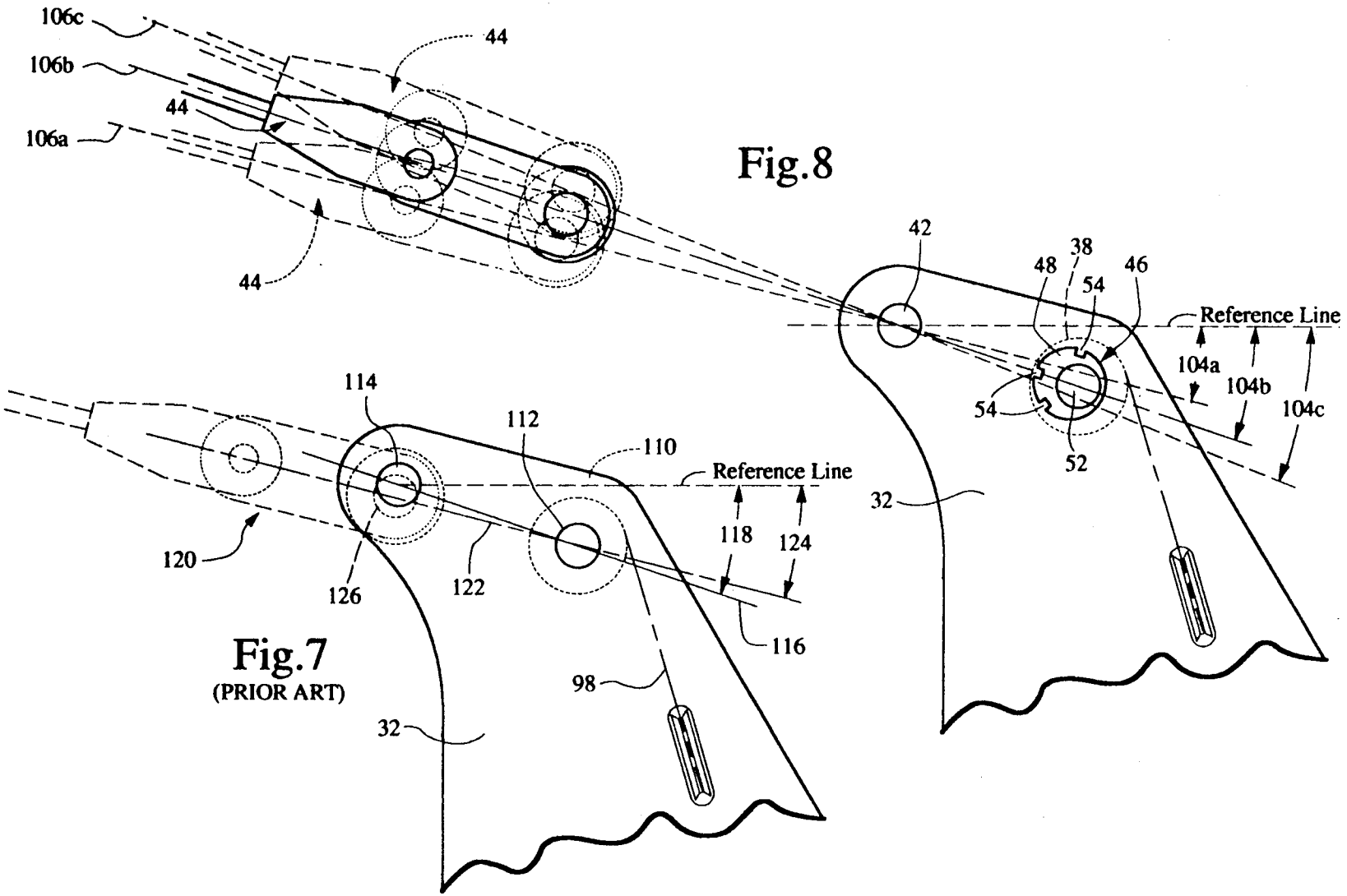
Fig.7 (PRIOR ART)
Figure 9A:
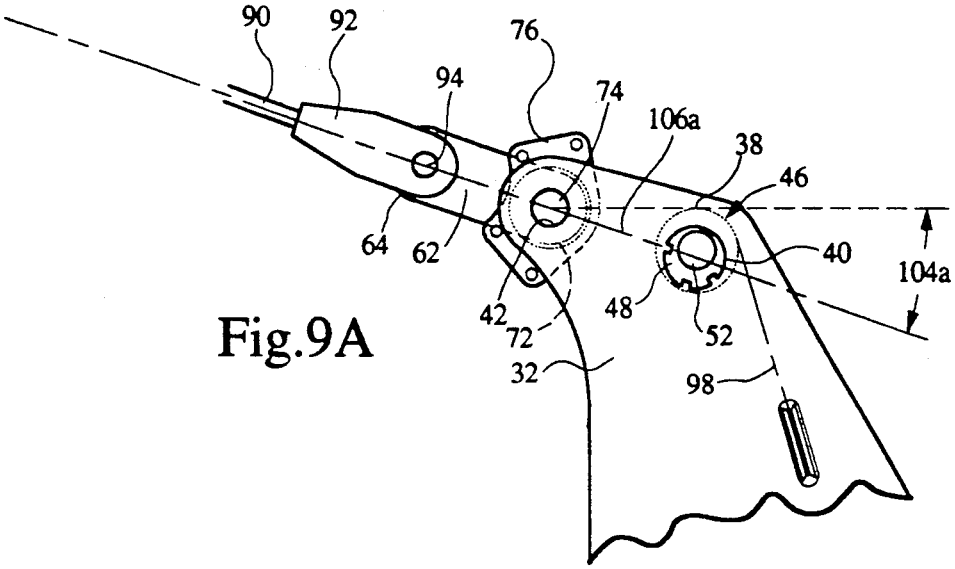

FIGS. 5A and B are side elevational views of a key for the alignment apparatus of FIG. 4;

FIG. 6 is a top view of a key retainer for the key of FIG. 5;

FIG. 7 is a side elevational view of a prior art boom support assembly;

FIG. 8 is a side elevational view of the boom support assembly of the present invention with various positions shown in phantom; and FIGS. 9A, B and C are side elevational views of the boom support assembly for different boom lengths in their operating positions.

DETAILED DESCRIPTION OF THE INVENTION

Figure 1:
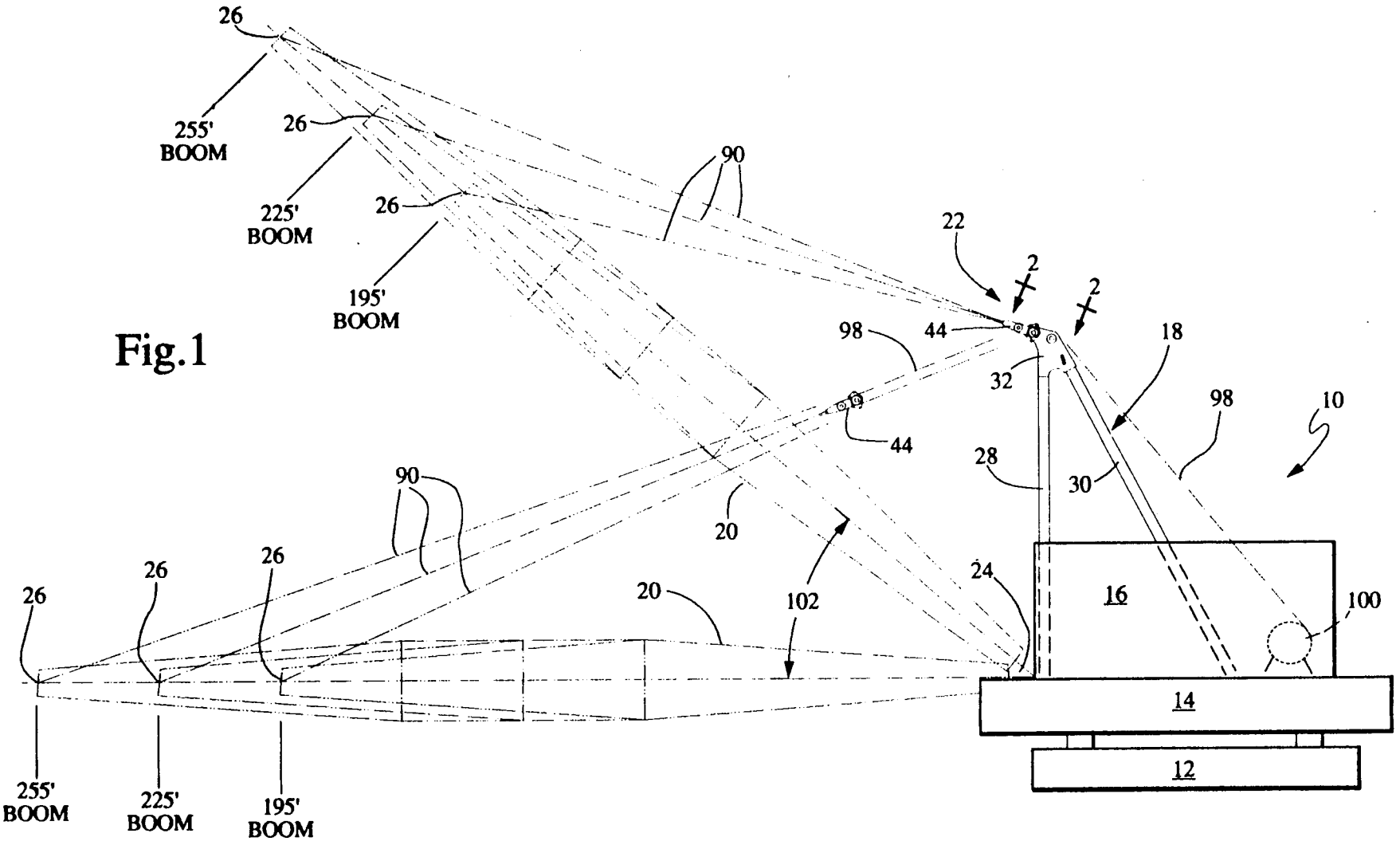
FIG. 1 is a side elevational view of a dragline excavator having a boom support assembly of the present invention.

With specific reference to FIG. 1, a dragline excavator 10 is illustrated with various boom lengths shown in the starting (horizontal) position and the operating position. The dragline excavator 10 is shown mounted on a tub 12 located on the ground but may also be mounted on a crawler unit. The excavator 10 includes a main frame 14 rotatably mounted on tub 12, a housing 16 on the main frame 14, an upwardly rising gantry 18, a boom 20 at one end and a boom support assembly 22.

The boom 20 is shown in three lengths (195 feet, 225 feet and 250 feet) and may be made shorter or longer to accommodate the mine conditions. The boom 20 is assembled in the horizontal starting position generally parallel with the ground. A first end 24 of the boom 20 is pivotally attached to the main frame 14, and an opposite end has a boom point 26 secured to a tension member.

Figure 2:
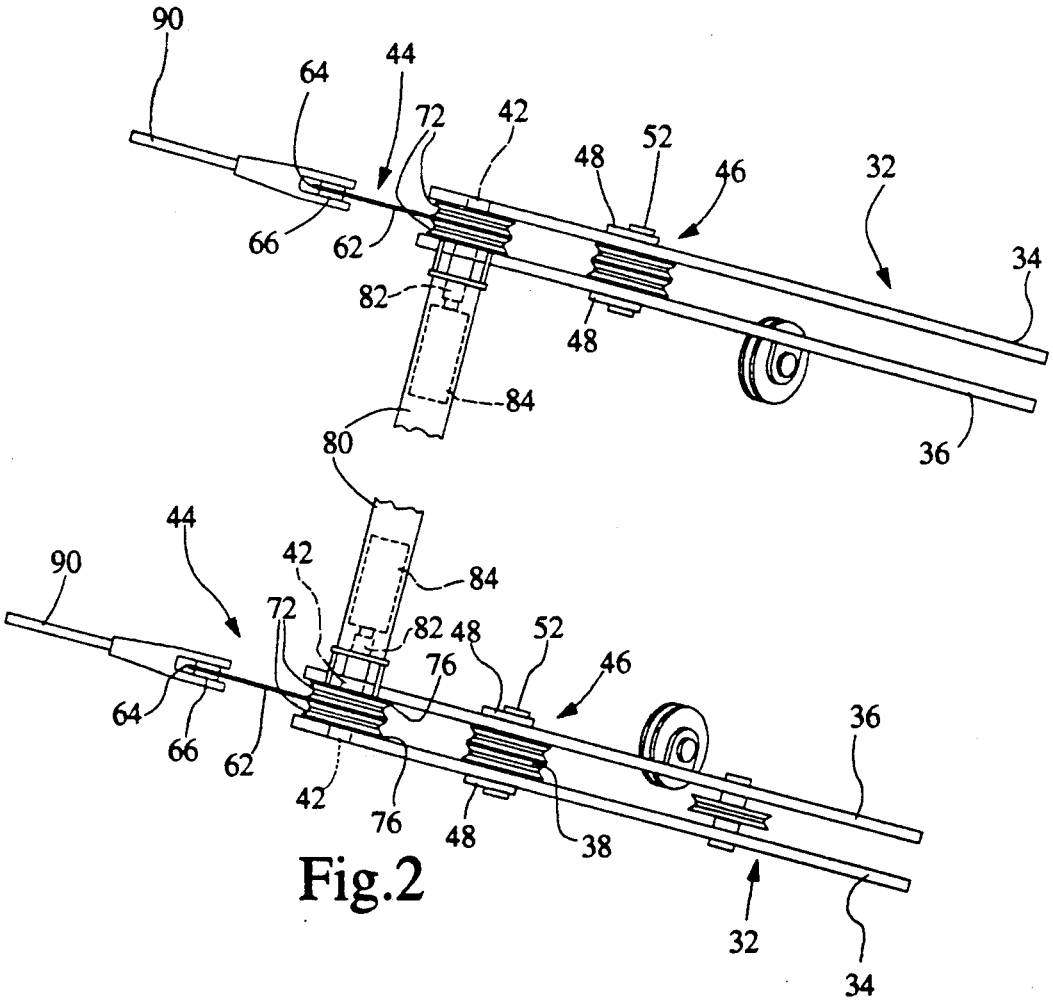
FIG. 2 is an enlarged top view taken along sectional lines 2—2 of FIG. 1.

The gantry 18 is a structure having front legs 28 and rear legs 30 attached to the main frame 14. The front legs 28 serve to transfer gantry boom loading to the main frame 14, while the rear legs 30 act as tension members for the gantry structure. The front legs 28 and rear legs 30 are joined at the top by a bridge connector 32. As shown in FIG. 2, there are two bridge connectors 32 for the two front legs 28 and two rear legs 30.

Figure 3:
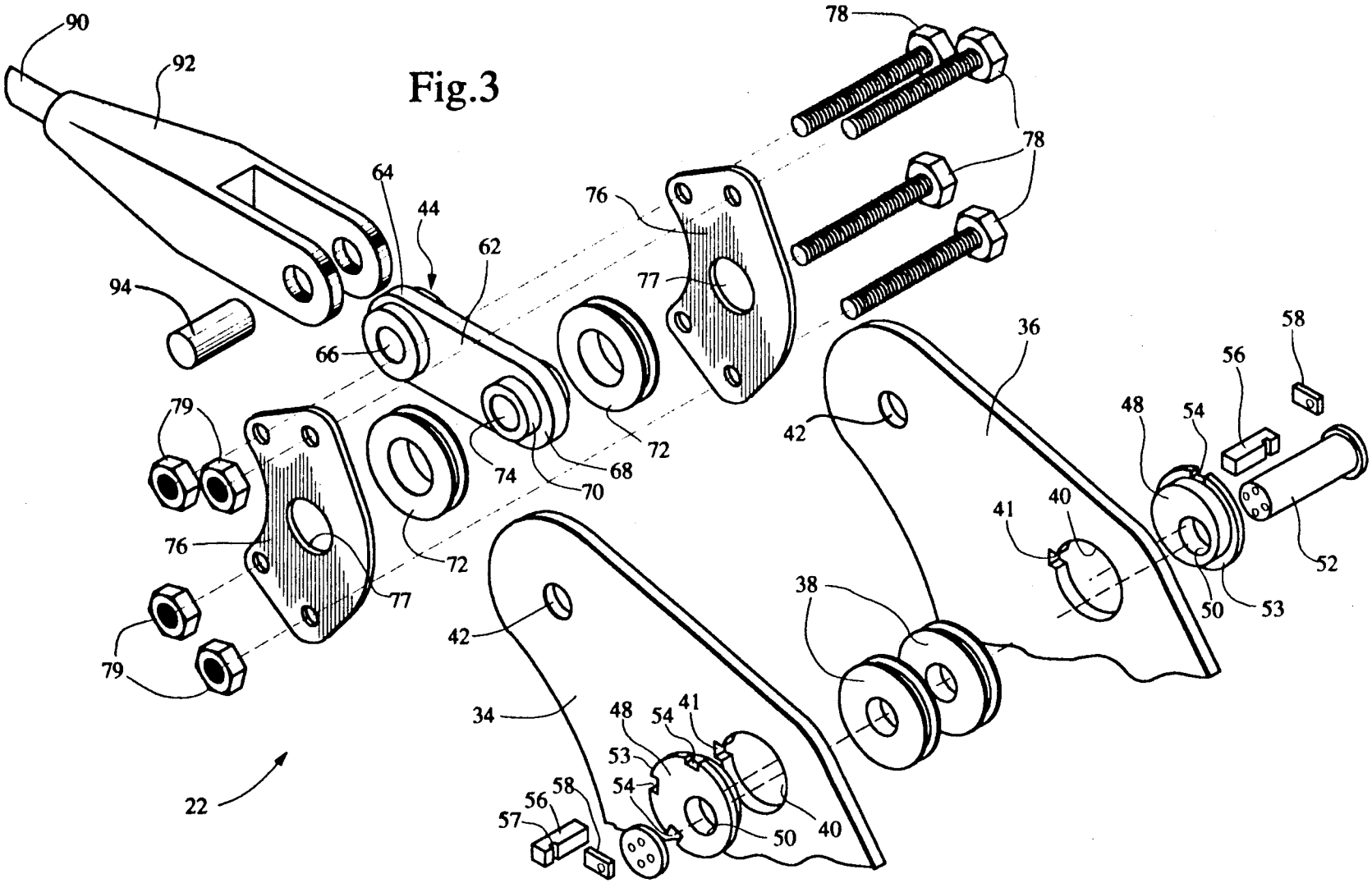
FIG. 3 is an exploded view illustrating in detail the boom support assembly of FIG. 2.

Each bridge connector 32 has a pair of plates 34, 36 and a plurality of gantry sheaves 38, preferably two, disposed between the upper portion of plates 34 and 36. As shown in FIG. 3, each plate 34, 36 has aligned large diameter bore 40 with an adjacent key slot 41 and a small diameter support opening 42 forward from bore 40.

The boom support assembly 22 includes a pendant pin link assembly 44, an alignment apparatus 46 and a pair of tension members attached to the pendant pin assembly 44. As shown in FIGS. 2 and 3, the alignment apparatus 46 includes a pair of circular cartridges 48 with an eccentric bore 50 formed therein, and a gantry sheave shaft 52 received through both eccentric bores 50. Each cartridge 48 has a circumferentially extending shoulder 53 with plurality of notches 54 through the periphery. The cartridges 48 are inserted in large bores 40 of plates 34, 36 in mirror symmetrical relationship with shoulders 53 abutting plates 34, 36. Gantry sheaves 38 are disposed between cartridges 48 and are rotatably mounted on sheave shaft 52. Additionally, the alignment apparatus 46 includes a key 56 with a slot 57 and key retainer 58 to prevent cartridges 48 from rotating within bore 40.

The pendant pin link assembly 44 includes a pendant pin link 62 having a first end 64 preferably with a bore 66 formed therein, a second end 68 preferably having a hub 70 on which a pair of pendant sheaves 72 are rotatably mounted thereon and a bore 74 axially through hub 70 (see FIG. 3). A pair of retainers 76 have an opening 77 that is received over hub 70. The retainers 76 are held together by bolts 78 and nuts 79 to prevent pendant sheaves 72 from moving laterally off of hub 70.

Preferably a spacer cylinder 80 is secured to the inner retainer 76 as shown in FIG. 2. The cylinder 80 has opposite open ends axially aligned with the through bore 74 of the pin link 62. The spacer cylinder 80 includes a boom support pin 82 and an air cylinder 84 to push support pin 82 through the open ends of spacer cylinder 80, support opening 42 and pin link bore 74 to secure pendant pin link assembly 44 to the gantry 18.

The first tension member is a boom support pendant 90 that is attached to the first end 64 of the pendant pin link 62, preferably by a pin 94 through a link 92 and bore 66 (see FIG. 4). The boom support pendant 90 is also fixedly attached to the boom point 24 of the boom 20. The second tension member is a boom raising wire rope 98 that extends from a winch 100 to gantry sheaves 38 around pendant sheaves 72 of the pendant pin assembly 44 and secured to the gantry 18. This rope 98 draws pendant pin assembly 44 in a straight line to the gantry sheaves 38 and sheave shaft 52.

As shown in FIG. 1, dragline excavator 10 has an optimum operating position for its boom defined by an angle 102 from the horizontal starting position, irrespective of the boom length. In this operating position, an axis through the boom support pendant 90, the pendant pin assembly 44 and the sheave shaft 52 is illustrated as line 106 which creates an entry angle 104 with respect to a reference line (see FIG. 8). For the through bore 74 of the pin link 62 to concentrically align with support opening 42, the axis line 106 must intersect the centerline axis of the support opening 42.

As shown in FIG. 7, the prior art excavator has gantry sheaves 110 rotatably mounted on a fixed sheave shaft 112 and an opening 114 aligned along line 116. This line 116 is at an angle 118 from a reference line that is equal to the necessary entry angle for a support pendant for a particular boom length, so that a pendant pin link assembly is in proper alignment with opening 114. If the boom length is changed (shown decreas in FIG. 7), a pendant pin assembly 120 enters the gantry along a line 122 at an entry angle 124 which results in a misalignment of the pendant pin assembly through bore 126 with the gantry support opening 114.

The boom support assembly 22 of this invention compensates for varying boom lengths by adjusting the centerline axis of the sheave shaft 52 to adjust the entry angle of the pendant pin assembly 44. As shown in FIG. 8, as the boom length is changed, the axis lines 106*a, b, c* through the boom support pendant 90 and the pendant pin link assembly 44 forms varying entry angles 104*a, b, c* with respect to the reference line. The intersection of line 106 with the centerline axis of opening 42 is accomplished by rotating cartridge 48 so that the centerline axis of sheave shaft 52 moves upward or downward to align line 106 across opening 42. By determining the boom lengths for a particular dragline excavator, a cartridge may be designed to have an eccentric bore that will provide the required centerline axis of the sheave shaft necessary for aligning the pendant pin assembly 44 with the support opening 42. Each notch 54 placed on the periphery of the cartridge 48 correlates with the necessary entry angle of the pendant pin link assembly for each boom length.

In operation, when a particular boom length is used (i.e., 225 foot), the eccentric cartridge 48 is rotated so that the notch 54 designated for the 225 foot length of boom is adjacent key slot 41 (see FIG. 4). The key 56 is inserted through slot 41 and notch 54 to hold the cartridge 48 in this fixed position. The retainer 58 is inserted into slot 57 and secured by a screw to the gantry 18. The winch 100 then reeves the boom raising ropes 98 to draw the pendant pin link assembly 44 into the top portion of the gantry 18 at an entry angle that is aligned with the centerline axes of opening 42 and sheave shaft 52.

As shown in FIG. 9A, the necessary entry angle 104*a* is 14,487° for a 195 foot boom at an operating angle of 41°. The eccentric cartridge 48 is rotated to the notch 54 next to the marking 195 (see FIG. 4) and thereby elevates the gantry sheave shaft 52 centerline axis to line up the entry of the pendant pin assembly 44 with opening 42 and assures that through bore 74 will be concentrically aligned with opening 42. Support pins 82 may then be manually inserted through the support opening 42 and through bore 74 of the pin link 62, or preferably automatically actuated from within the spacer cylinder 78 by air cylinder 84 through the support openings 42 and the pin link through bore 74. The boom raising rope 98 may then be removed for storage or use on another excavator.

Figure 9B:
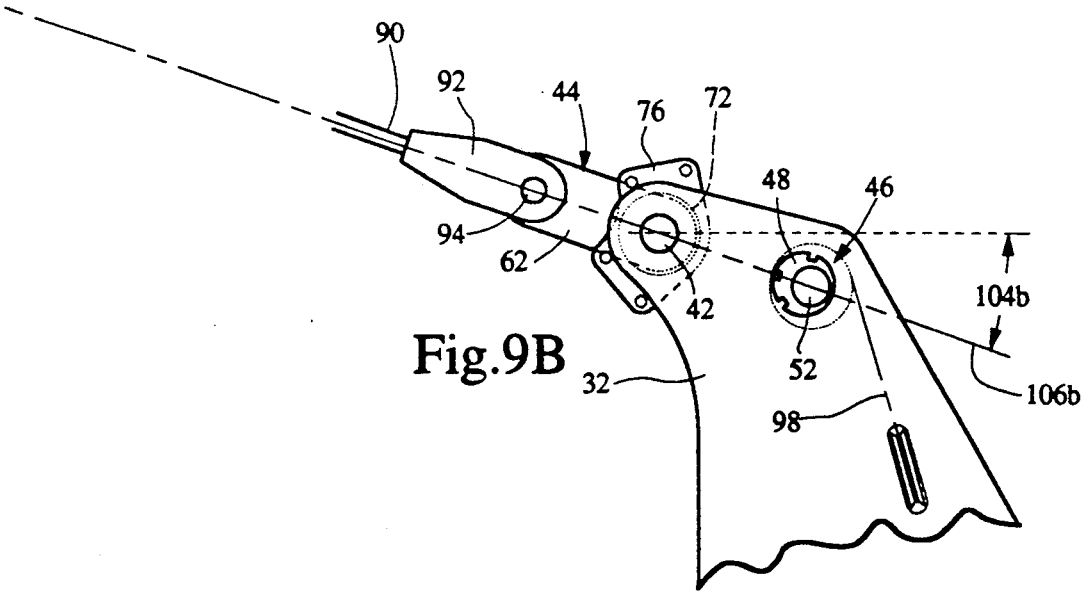
Figure 9C:
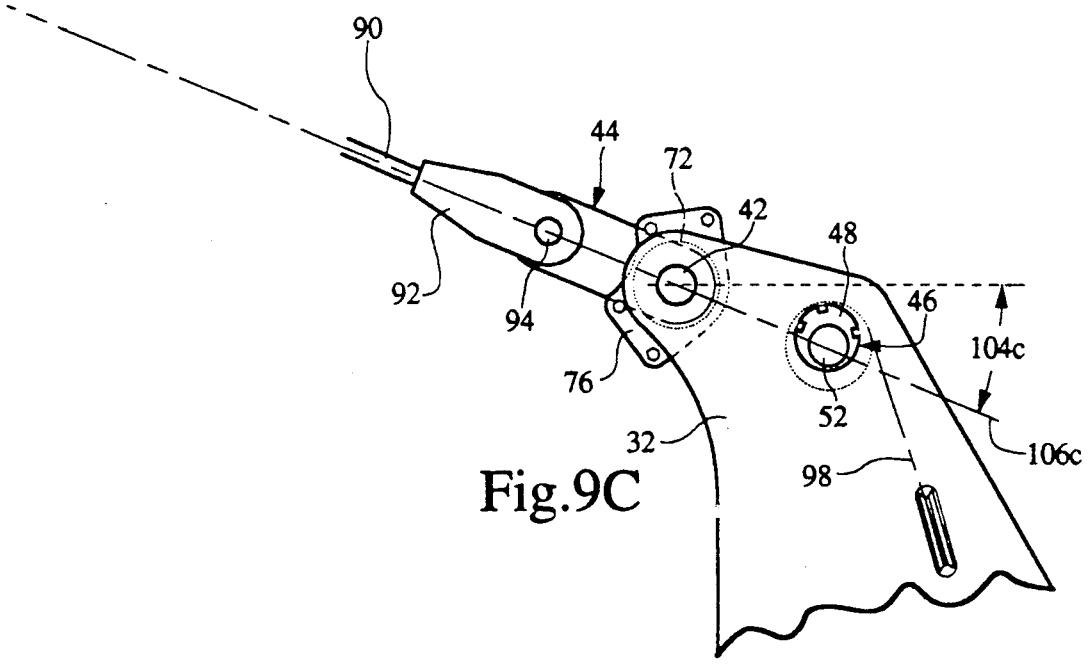

For a 225 foot boom the eccentric cartridge 48 is rotated clockwise to the center notch 54 as shown in FIG. 9B, which lowers the sheave shaft 52 and accordingly line 106*b* so that support opening 42 is concentrically aligned with the through bore 74 of the pendant pin retainer 44. As shown in FIG. 9C, the axis of the boom support pendant for a 255 foot boom must be at an entry angle 104C of 22.383° for proper alignment. This requires eccentric cartridge 48 to be rotated clockwise to further lower the centerline axis of the sheaves shaft 52 and the axis line 106*c* through boom support pendant 90 and pendant pin assembly 44. FIGS. 9A, B and C illustrate by example different possible boom lengths.

It is to be understood that the terminology as employed in the description and claims incorporated herein is used by way of description and not by way of limitation, to facilitate understanding of the structure, function and operation of the combination of elements which constitute the present invention. Moreover, while the foregoing description and drawings illustrate in detail one successful working embodiment of the invention, to those skilled in the art to which the present invention relates, the present disclosure will suggest many modifications in the construction, as well as widely differing embodiments and applications without thereby departing from the spirit and scope of the invention. The present invention, therefore, is intended to be limited only by the scope of the appended claims and applicable prior art.

What is claimed is:

1. A boom support assembly for a multiple boom earth-working machine having a rotatable frame, a gantry mounted on said frame and a variable length boom pivotally mounted on said frame, said boom support assembly comprising:

a) means for raising said boom to an operating position at an optimum angle, said raising means including a first tension member received over the top portion of said gantry having a support opening formed therein, and a pendant pin link having a first end and a second end with a through bore, said second end secured to one end of said first tension member;

b) a second tension member having a first end attached to said first end of said pendant pin link and a second end attached to a boom point of said boom;

c) means for aligning said through bore of said pendant pin link with said support opening for each boom length of the earth-working machine; and d) means for locking said pendant pin link to said gantry wherein said locking means is received through said support opening and said through bore of said pendant pin link.

2. The boom support assembly as set forth in claim 1 wherein said raising means further comprises a winch mounted on said frame and a sheave mounted on the top portion of said gantry, said winch is attached to a free end of said first tension member that is received on said gantry sheave, whereby said winch raises said boom to an operating position by reeving said first tension member and locating said pendant pin through bore concentrically aligned with said support opening of said gantry.

3. The boom support assembly as set forth in claim 2 wherein said first tension member is a wire rope.

4. The boom support assembly as set forth in claim 1 wherein said aligning means comprises:

a) said gantry having a slot formed in the top portion, the top portion of said gantry having a pair of opposed bores and a second support opening axially aligned with said first support opening across said slot;

b) a pair of cartridges, each having an eccentric bore, said cartridges are rotatably located in said opposed bores of said gantry in mirror symmetrical relationship;

c) a plurality of sheaves; and d) a sheave shaft receivable through said eccentric bores and said plurality sheaves positioned between said cartridges in said gantry slot so that rotation of said cartridges adjust the axis through said second tension member and said sheave shaft to intersect said support openings.

5. The boom support assembly set forth in claim 4 wherein said aligning means further comprises:

a) a shoulder about the perimeter of said cartridges having a plurality of notches formed therein;

b) a keyway formed in said gantry adjacent said opposed bores; and c) a key engageable in said notch and said keyway to hold said cartridge in a fixed position relative to said gantry.

6. The boom support assembly as set forth in claim 4 wherein said locking means is a support pin receivable through said support openings and said pin link through bore.

7. The boom support assembly as set forth in claim 6 wherein said locking means further comprises a housing attached to said top gantry portion coaxially aligned with said support opening, and an air cylinder coupled to said support pin within said housing so that when said pendant pin link through bore is adjacent said support openings, said air cylinder is actuated to push said support pin through said support opening and said pendant pin link through bore.

8. A boom support assembly for a multiple boom earth-working machine having a rotatable frame, a gantry mounted on said frame and a variable length boom pivotally mounted on said frame, said boom support assembly comprising:

a) a winch mounted on said frame;

b) a plurality of sheaves interposed between plates on the top portion of said gantry, said plates having a pair of aligned support openings adjacent said sheaves;

c) a pendant pin link having a first end and a second end with a through bore;

d) boom support pendant having a first end attached to said first end of said pendant pin link and a second end attached to a boom point of said boom;

e) boom raising wire rope received on said gantry sheaves having a first end attached to said winch, and a second end attached to said second end of said pendant pin link, such that said winch raises said boom to an operating position by reeving said boom raising rope and locating said pendant pin link between said support openings of said plates;

f) means for aligning said through bore of said pendant pin link with said support openings for varying boom lengths; and g) means for locking said pendant pin link to said gantry, wherein said locking means is received through said support openings and said through bore of said pendant pin retainer, so that said boom is held in the operating position at an optimum angle by said boom support pendant attached to said secured pendant pin link.

9. The boom support assembly as set forth in claim 8 where said aligning means comprises:

a) a pair of cartridges, each having an eccentric bore and a plurality of notches about the perimeter, said cartridges are rotatably mounted in bores formed in said plates of said gantry in a mirror symmetrical relationship;

b) a sheave pin receivable through said eccentric bores and said gantry sheaves positioned between said cartridges; and c) a key receivable in said cartridge notch and a keyway adjoining said bores in said gantry to hold said cartridges in a fixed position relative to said gantry, so that said sheave shaft aligns the axis of said boom support pendant to intersect said support openings, and said pendant pin link through bore is concentrically aligned with said support opening of said gantry to receive said locking means.

10. The boom support assembly as set forth in claim 9 wherein said locking means is a support pin receivable through said support openings and said pendant pin link through bore.

* * * * *